United States Patent [19]

Campbell

[11] Patent Number: 4,711,439

[45] Date of Patent: Dec. 8, 1987

[54] VICE JAW SUPPORT APPARATUS

[75] Inventor: Edward N. Campbell, Oklahoma City, Okla.

[73] Assignee: Dana Corporation, Toledo, Ohio

[21] Appl. No.: 913,177

[22] Filed: Sep. 29, 1986

[51] Int. Cl.[4] ..... B25B 1/24

[52] U.S. Cl. ..... 269/277; 269/275; 269/273

[58] Field of Search ..... 269/271, 274, 275, 277, 269/278, 273, 252, 253, 287; 24/300, 371, 523, 590

[56] References Cited

U.S. PATENT DOCUMENTS

| | | | |
|---|---|---|---|
| 1,025,739 | 5/1912 | Davis | 269/277 X |
| 1,136,853 | 4/1915 | Walters | 269/277 |
| 1,672,808 | 6/1928 | Hansel | 269/277 X |
| 2,838,971 | 6/1958 | Shekter | 269/277 X |
| 3,322,423 | 5/1967 | Popow et al. | 269/274 |
| 4,558,856 | 12/1985 | Shaffer | 269/277 |

FOREIGN PATENT DOCUMENTS

| | | | |
|---|---|---|---|
| 154281 | 3/1982 | Fed. Rep. of Germany | 269/277 |

OTHER PUBLICATIONS

H. M. Fay, "A Spring Block for Use in a Milling Machine Vise," in *Amer. Mach.*, Oct. 7, 1920.

*Primary Examiner*—Robert P. Olszewski
*Assistant Examiner*—Judy J. Hartman
*Attorney, Agent, or Firm*—Frank B. McDonald

[57] ABSTRACT

A vice jaw support apparatus provides a novel support system for securement of splined and threaded work pieces within vice grippers or jaws. In a preferred form, the apparatus is formed of a polyethylene or other similar resilient material. In a preferred form, the apparatus defines a pair of plastic bodies which are interconnected by integral web portions joining the two bodies on opposite sides. The web portions are disposed for deforming outwardly when the two body portions are moved towards each other within the vice jaws. Each body contains a flange portion whereby the apparatus may be supported on the upper surfaces of associated vice jaws.

7 Claims, 6 Drawing Figures

VICE JAW SUPPORT APPARATUS

BACKGROUND OF THE INVENTION

This invention relates to apparatus for supporting members having fragile or easily damaged surfaces within pairs of vice jaws for machining and/or making mechanical adjustments to such members. More particularly, the invention relates to a system of adapting a pair of traditional steel vice jaws for work which requires resilient gripping of workpieces having delicate surfaces, such as threaded or splined members which are to be contained within the vice jaws without damage to the threaded or splined surfaces.

There are numerous prior art systems for providing resilient contact of workpieces supported within pairs of vice jaws. Most, however, are cumbersome in their utilication and/or are difficult or awkward to manufacture. Most of the devices are of a two piece construction, without interconnections between the two pieces. In cases involving an interconnection between the two separate body portions, the connection is hinged and results in an undesirable pivotal action whenever the body members are moved relative to one another.

Preferably, the action of such an interconnected pair of resilient bodies is linear, and is thus commensurate with the linear movement of the associated pair of vice jaws as the latter move to and from each other. Linear action is not only more easily adaptive to the vice jaw action, but also avoids the imposition of an inherent torque load upon a workpiece during the time a pivotally arranged device is in contact with the workpiece.

SUMMARY OF THE INVENTION

The vice jaw support apparatus as disclosed herein embodies a resilient molded construction suitable for quick, simple installation between a pair of vice jaws. In one preferred embodiment, the apparatus is of a one piece construction, wherein the jaw inserts are integrally and resiliently joined together by a molded webbing system to provide non-pivotal, linear movement of the inserts relative to each other.

The jaw inserts are formed of a resilient material, preferrably polyethylene. Each insert has a coacting mating surface disposed for resilient surface contact of a workpiece, such as a threaded or splined member, and holding same between the mating surfaces. The webbing is integrally joined on opposite sides of the pair of jaw inserts, and each coacting mating surface provides either an arcuate concave depression or a wedge-shaped depression for resilient contact with the workpiece.

In another preferred embodiment, the pair of jaw inserts are molded into two separate and distinct bodies, and are coupled together by means of slidable pins extending through bores within the separate bodies. The slidable pins afford the desireable linear movement of the bodies to and from each other.

DETAILED DESCRIPTION OF PREFERRED EMBODIMENTS

Figure 1:
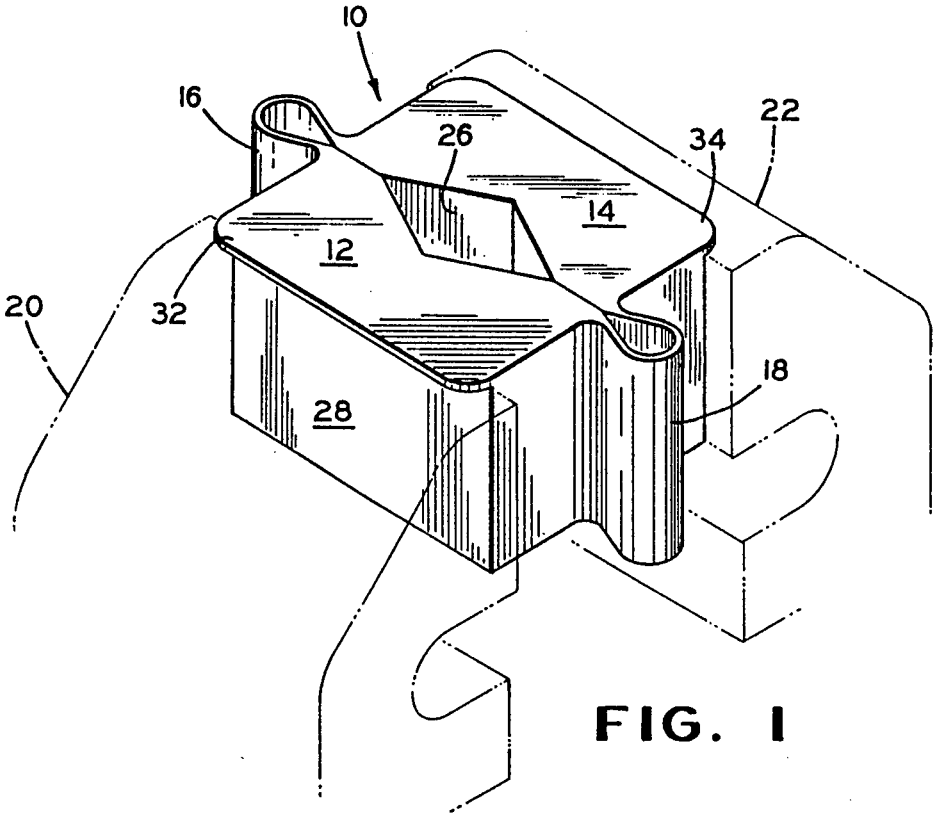
FIG. 1 is a perspective view of one preferred embodiment of the vice jaw support apparatus of the present invention, shown in a closed position.
Figure 2:
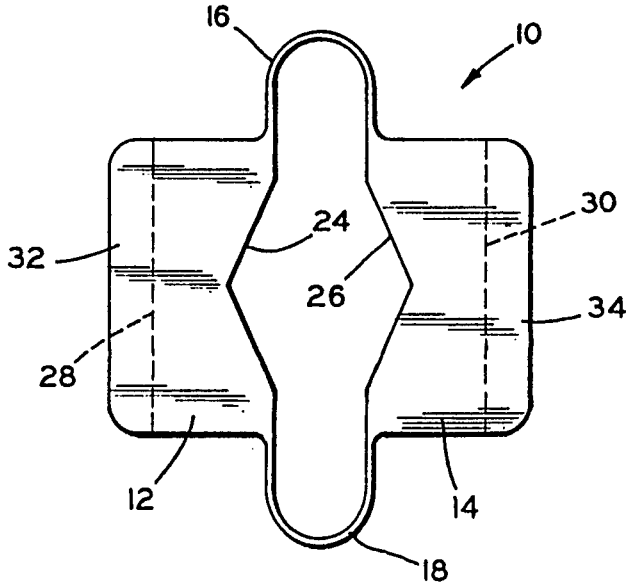
FIG. 2 is a plan view of the apparatus of FIG. 1, shown in an open position.

Referring initially to FIGS. 1 and 2, a vice jaw support apparatus constructed in accordance with a first presently preferred embodiment of the invention is shown. The support apparatus 10 includes a left jaw insert 12 and a right jaw insert 14 which are reversely identical, and which are resiliently and integrally connected by flexible web connectors 16 and 18.

In the presently preferred mode of construction, the apparatus is formed of a high molecular weight polyethylene material, although any one of several resilient synthetic materials may be utilized. In the embodiment of FIGS. 1 and 2, the left and right jaw inserts 12 and 14 move to and from one another in a non-pivotal, linear motion. The flexible web connectors 16 and 18 are of reversely identical construction, being of the same material as the inserts, and preferably having identical thicknesses. The presently preferred embodiment of FIG. 1 contemplates web connector thicknesses in the range of 25 to 30 thousandths of an inch.

The support apparatus 10 is adapted to be positioned within a pair of vice jaws 20 and 22, as shown in phantom. The left jaw insert contains a left gripping surface 24 defined by a concavity, while the right jaw insert 14 contains a right gripping surface 26 which defines a reversely identical concavity adapted to coact with the other for the purpose of resiliently holding a splined or threaded shaft or other delicately machined and/or easily damaged work piece. In this first preferred embodiment, the gripping surfaces 24 and 26 are wedge-shaped planar surfaces as shown.

The left jaw insert 12 contains a jaw engaging surface 28 which is adapted for engagement by the left vice jaw 20. Conversely, the right jaw insert 14 contains a right jaw engaging surface adapted for engagement by the right vice jaw 22. The support apparatus 10 also includes a pair of left and right support flanges 32 and 34, positioned on inserts 12 and 14 respectively, which facilitate the positioning of the apparatus over the left and right vice jaws.

Figure 3:
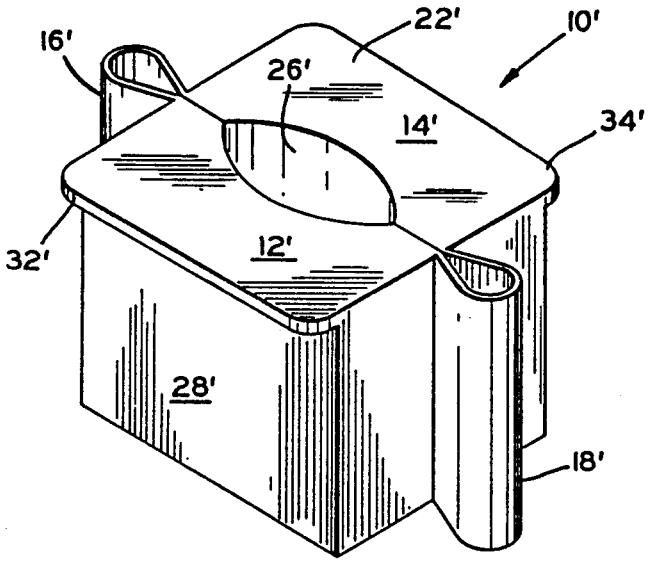
FIG. 3 is a perspective view of an alternate embodiment of the present invention, in closed position.
Figure 4:
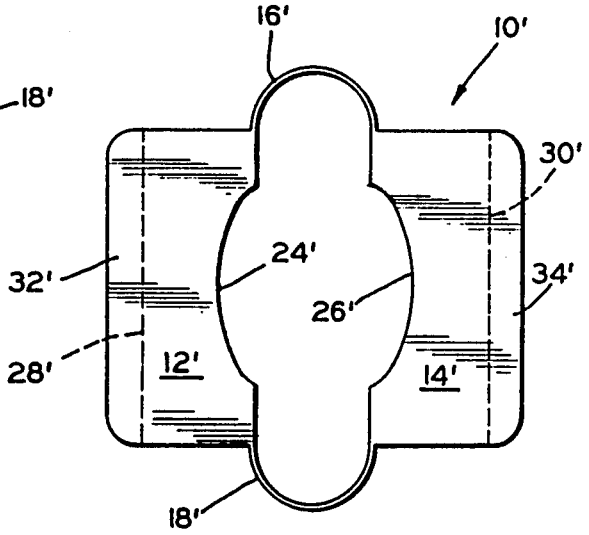
FIG. 4 is a plan view of the embodiment of FIG. 3, in open position.
Figure 5:
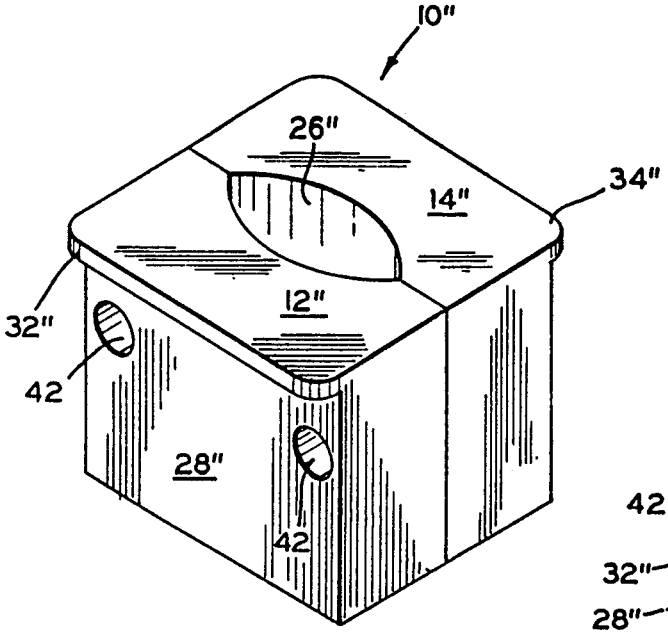
FIG. 5 is a perspective view of a third embodiment of the present invention, in closed position.

Referring now to FIGS. 3 and 4, a second preferred embodiment 10' of the support apparatus is shown. The latter embodiment contains left and right gripping surface 24' and 26' which define arcuate as opposed to the wedge-shaped planar surfaces contained in the embodiment of FIGS. 1 and 2. In all other respects, the embodiment of FIGS. 4 and 5 is identical to that of FIGS. 1 and 2. It will be appreciated that numerous other gripping surface designs, including for example scalloped or seesaw, can be utilized which fall within the spirit and scope of the present invention.

Figure 6:
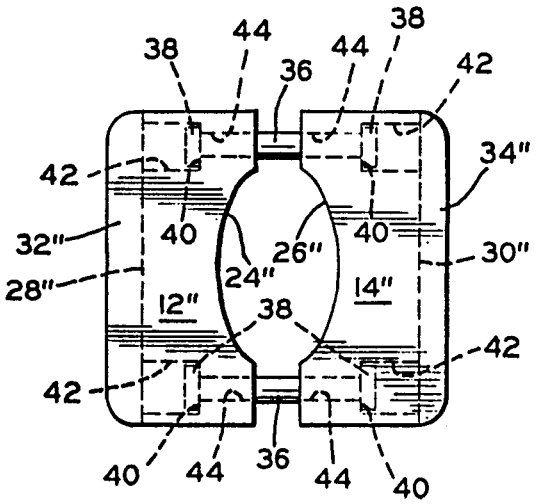
FIG. 6 is a plan view of the embodiment of FIG. 5, in open position.

A third preferred embodiment 10'' of the vice jaw support apparatus is shown in FIGS. 5 and 6. In the preferred form, this particular embodiment is formed of two distinct and separate bodies of polyethylene material. Thus, in comparison with the previously described embodiments, the embodiment 10'' includes no flexible web connectors to hold left and right jaw inserts 12'' and 14'' together. In lieu thereof, a pair of slidable pins 36 extend through sets of coaxial exterior and interior bores 42 and 44, respectively, situated within the inserts 12" and 14".

Referring more particularly to FIG. 6, each slidable pin 36 contains a head 38 disposed for movement within the outside bores 42 which are diametrically larger than the inside bores 44. The pin shafts 36 are slidably piloted within the latter smaller diameter bores 44. Each of the heads 38 makes contact with head contact surfaces 40 defined by a shoulder created by the interface of the bores 42 and 44. The inserts 12" and 14" are axially constrained by the heads 38 when pulled apart at opposite ends of the pins 36. Obviously, the pin lengths must fall within a design range choice which is suitable for permitting installation of a workpiece, as must the lengths of flexible web connectors 16, 18 of the first preferred embodiment.

Finally, in the third preferred embodiment, the depth of the outside bores 42 relative to the length of the pin shafts 36 are preferably such that the heads 38 will not protrude from the outside bores 42 when the support apparatus is in a closed position. However, the latter is a choice relating more to convenience than to function of the vice jaw support apparatus 10".

Several other convenience features are also envisioned, although not depicted. For example, sets of small coil springs could be installed over the pins 36 to cause the inserts 12" and 14" to be normally spring-loaded apart for greater ease of accommodation in the vice jaws 20 and 22.

Although only three presently preferred embodiments have been described herein, the appended claims are envisioned to cover numerous other embodiments which will fall within the spirit and scope thereof.

What is claimed is:

1. An apparatus for supporting a workpiece within a pair of vice jaws, said apparatus comprising a pair of jaw inserts, each insert comprising means for support on one jaw of said pair of vice jaws, each insert being formed of a resilient material and having coacting mating surfaces disposed for holding said workpiece, said inserts integrally joined together by means providing non-pivotal linear movement of each insert relative to the other, wherein said apparatus comprises a unitary molded construction, wherein said means of joinder of said inserts together comprises a pair of flexible webs formed as integral parts of said apparatus, said webs being integrally formed with said resilient unitary apparatus, said webs being positioned symmetrically on opposing sides of said mating surfaces, each of said webs attached integrally to one edge of one of said surfaces, each web being disposed to deform outwardly of said inserts when said inserts are moved toward one another.

2. The apparatus of claim 1 wherein said resilient material comprises a polyethylene.

3. The apparatus of claim 2 wherein said coacting mating surfaces define arcuate concave depressions for gripping said work piece.

4. The apparatus of claim 2 wherein said coacting mating surfaces define planar wedge-shaped depressions for gripping said work piece.

5. An apparatus for supporting a workpiece within a pair of vice jaws, said apparatus comprising a pair of jaw inserts, each being supported on one jaw of said pair of vice jaws, each insert comprising a resilient body of material having coacting mating surfaces thereon, wherein a first of the pair of inserts defines a pair of first bores therethrough, the second insert defining a pair of second bores therethrough, each one of said second bores in alignment with one of said first bores, and means slidably disposed within each set of aligned first and second bores for interconnecting said first and second inserts and providing non-pivotal, linear movement of said first and second inserts to and from one another, wherein each insert comprises a molded polyethylene, and wherein said means providing a non-pivotal, linear movement of said inserts relative to the other comprises a pair of elongated floating pins interconnecting said inserts, each pin having a head at each end, said sets of first and second bores each defining a set of coaxially positioned exterior and interior bore portions, said interior bore portions disposed for slidably piloting said floating pins, said exterior bore portions of said sets of first and second bores disposed for containment of said pin heads, wherein each interior bore portion has a smaller diameter than its associated coaxial exterior bore portion, and wherein said heads will not protrude from said exterior bores when said coacting mating surfaces of said jaw inserts are in contact with one another.

6. The apparatus of claim 5 wherein said coacting mating surfaces define arcuate concave depressions for gripping a workpiece.

7. The apparatus of claim 5 wherein said coacting mating surfaces define wedge-shaped depressions for gripping a workpiece.

* * * * *